US010512295B1

(12) United States Patent
Hanson et al.

(10) Patent No.: US 10,512,295 B1
(45) Date of Patent: Dec. 24, 2019

(54) PROTECTIVE HEADGEAR

(71) Applicant: Guardian Innovations, LLC, Peachtree Corners, GA (US)

(72) Inventors: Wallace Lee Hanson, Duluth, GA (US); Erin Nemec Hanson, Duluth, GA (US); Dave Lewandowski, Cumming, GA (US); Caitlin Hanson Gouws, Norcross, GA (US); Alexandra Hanson Garner, Peachtree Corners, GA (US); Matthew Mills Simonds, Atlanta, GA (US)

(73) Assignee: GUARDIAN INNOVATIONS, LLC, Peachtree Corners, GA (US)

( * ) Notice: Subject to any disclaimer, the term of this patent is extended or adjusted under 35 U.S.C. 154(b) by 0 days.

(21) Appl. No.: 15/818,137

(22) Filed: Nov. 20, 2017

Related U.S. Application Data

(63) Continuation-in-part of application No. 15/645,837, filed on Jul. 10, 2017.

(60) Provisional application No. 62/359,888, filed on Jul. 8, 2016.

(51) Int. Cl.

| | |
|---|---|
| ***A42B 3/12*** | (2006.01) |
| ***A42B 3/32*** | (2006.01) |
| ***A42B 3/08*** | (2006.01) |
| ***A42B 3/28*** | (2006.01) |
| ***A63B 71/10*** | (2006.01) |

(52) U.S. Cl.
CPC ..... *A42B 3/324* (2013.01); *A42B 3/08* (2013.01); *A42B 3/127* (2013.01); *A42B 3/283* (2013.01); *A63B 71/10* (2013.01)

(58) Field of Classification Search
CPC .... A42B 3/10; A42B 3/32; A42B 1/04; A42B 3/125; A42B 3/12; A42B 3/127
USPC ..... 2/411, 414, 425
See application file for complete search history.

(56) References Cited

U.S. PATENT DOCUMENTS

| | | | | |
|---|---|---|---|---|
| 3,786,519 | A | 1/1974 | Ade | |
| 4,843,642 | A | 7/1989 | Brower | |
| 5,177,815 | A * | 1/1993 | Andujar | A42B 3/00 2/411 |
| 5,421,035 | A * | 6/1995 | Klose | A42B 3/066 2/411 |
| 5,448,780 | A * | 9/1995 | Gath | A42B 3/08 2/411 |
| 5,544,367 | A | 8/1996 | March, II | |
| 6,021,525 | A * | 2/2000 | Mertins | A42B 1/067 2/172 |
| 6,427,253 | B1 * | 8/2002 | Penny | A42B 3/00 2/412 |
| 8,739,316 | B1 | 6/2014 | Norton | |
| 9,775,394 | B2 | 10/2017 | Dagan | |

(Continued)

*Primary Examiner* — Tajash D Patel
(74) *Attorney, Agent, or Firm* — BakerHostetler

(57) ABSTRACT

A protective headgear and headgear adjustment system is described. An example protective headgear may comprise a front section comprising padding configured to conform to a shape of a head of a wearer, a back section attached to the front section. The back section may comprise one or more adjustment members adjacent an opening in the back section. The protective headgear may comprise one or more pads configured to removeably attach to the adjustment member to define a horizontal adjustment and a vertical adjustment of the back section and at least partially cover the opening in the back section.

29 Claims, 9 Drawing Sheets

(56) References Cited

U.S. PATENT DOCUMENTS

| | | | | |
|---|---|---|---|---|
| 2001/0016958 | A1* | 8/2001 | Linday | A42B 1/067 2/10 |
| 2004/0226077 | A1 | 11/2004 | Toth | |
| 2005/0278832 | A1 | 12/2005 | Harrington | |
| 2015/0342280 | A1* | 12/2015 | James | A42B 1/225 2/172 |

* cited by examiner

PROTECTIVE HEADGEAR

CROSS-REFERENCE TO RELATED APPLICATIONS

This application is continuation-in-part of U.S. application Ser. No. 15/645,837, filed Jul. 10, 2017, which is a non-provisional of, and claims priority to, U.S. Provisional Application No. 62/359,888, filed Jul. 8, 2016, each of which are incorporated herein by reference in their entireties.

TECHNICAL FIELD

This invention relates to the field of protective headgear. More specifically, the invention pertains to adjustable headgear.

BACKGROUND

Protective headgear worn by athletes and sport enthusiasts typically includes some form of padding to prevent injury to the athlete's head. Such injuries can result from a magnitude of athletic activities including football, flag football, 7 on 7 football, rugby, soccer, field hockey, lacrosse, basketball, cycling, or in-line skating etc.

The existing forms of padding are relatively inflexible and are not shaped to bend to the contour of the athlete's head. Further, current protective headgear does not allow for precise adjustment. The athletes are currently unable to adjust their protective headgear to uniquely fit their particular head shape.

There exists a need in the art for protective headgear that allows the athlete to adjust the protective headgear to fit their unique head shape to provide the best fit possible providing maximum protection during athletic events.

SUMMARY

In an embodiment, an example protective headgear may comprise a front section comprising padding configured to conform to a shape of a head of a wearer, a back section attached to the front section. The back section may comprise one or more adjustment members adjacent an opening in the back section. The protective headgear may comprise one or more pads configured to removeably attach to the adjustment member to define a horizontal adjustment and a vertical adjustment of the back section and at least partially cover the opening in the back section.

In another embodiment, an example apparatus may comprise a three-point adjustment system comprising three hook and loop closure points disposed in a back opening of a protective headgear and allowing for horizontal adjustment and vertical adjustment of a size the protective headgear. The protective headgear may comprise a padded section configured to conform to a shape of a head of a wearer.

In another embodiment, an example adjustment system for protective headgear may comprise a first adjustment member defining a first portion of a back opening of a protective headgear, a second adjustment member defining a second portion of the back opening, a third adjustment member defining a third portion of the back opening, and a flap configured to removeably cover at least a portion of the back opening. The first adjustment member, the second adjustment member, and the third adjustment member may be configured to removeably attach to the flap when at least partially covering the back opening, thereby adjusting a size of the protective headgear and causing padding of the protective headgear to conform to a head of a wearer.

In yet another embodiment, the protective headgear of the present disclosure utilizes closed cell compression molded foam combined with mesh and hook and loop closures and elastic strap that allow the protective headgear to have a more custom fit than other protective headgear on the market. The three-point adjustment system allows the athlete to fit the size and shape of the headgear both horizontally and vertically to their particular head.

BRIEF DESCRIPTION OF THE DRAWINGS

The following detailed description of preferred embodiments is better understood when read in conjunction with the appended drawings. For the purposes of illustration, there is shown in the drawings exemplary embodiments; however, the subject matter is not limited to the specific elements and instrumentalities disclosed. In the drawings.

DETAILED DESCRIPTION OF ILLUSTRATIVE EMBODIMENTS

In an aspect, the present disclosure relates to an apparatus and an adjustment system thereof. The apparatus may comprise protective headgear. The protective headgear may be designed for a user engaged in a dangerous activity, such as sports. The apparatus may comprise padding to protect the wearer from injury. The padding may be comprised of medium density closed cell outer foam, a semi-rigid moldable composite core, and low-density interior foam. The mix of these particular materials allows for the reduction of the force that is incurred by potential hits to the athletes head.

The apparatus may comprise a flexible material attached to the padding. The flexible material may allow the apparatus to adapt to the shape of the wearer's head. The flexible material may be breathable allowing for ventilation of the wearer. It should be understood that the relationship between the flexible material and padding is such that various patterns can be deployed to achieve the objectives of the disclosure.

The apparatus may comprise an adjustment system. The adjustment system may comprise hook and loop closure points or other fasteners (e.g., any set/release mechanism) that can be adjusted horizontally and vertically to secure the headgear to the size and shape of the wearer's head. The adjustment system may comprise a multi-point adjustment system that allows for one or more pads to be pulled up and attached to the fasteners. The adjustment system may comprise an inner pad that attaches to an interior of the apparatus and an outer pad that attaches to an exterior of the apparatus.

In the inside of the apparatus, interior padding may be used that comprises compression molded padding creating air flow channels which keep the wearer cool. An elastic strap on a lower portion of the back of the apparatus allows the athlete to take the helmet on and off without having to adjust the fit. Once the apparatus is on the wearer, the apparatus also assists in providing a secure fit by sitting underneath the occipital bone.

Figure 1:
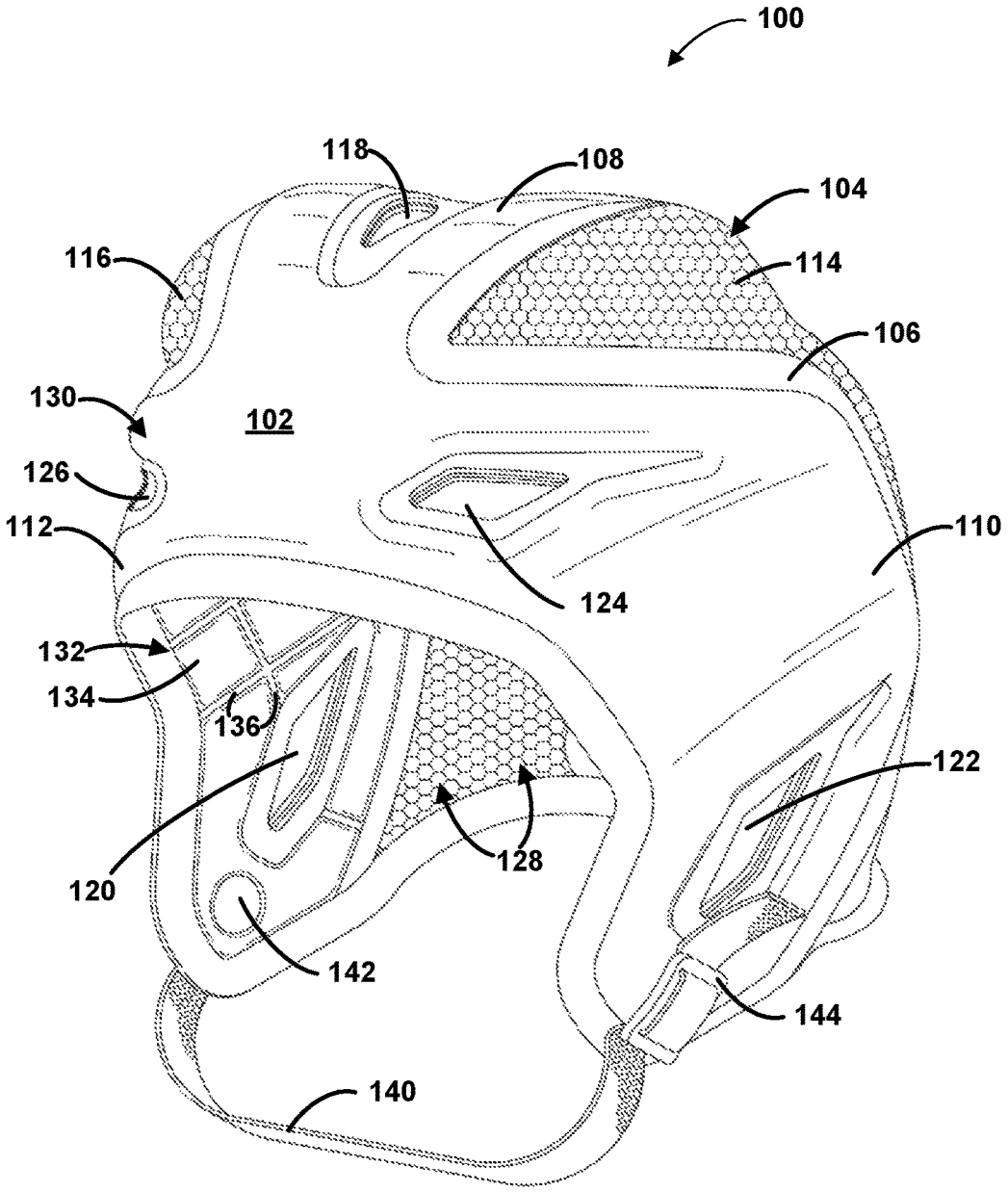
FIG. 1 is a front perspective view of an example apparatus in accordance with the present disclosure.

FIG. 1 is a front perspective view of an example apparatus 100 in accordance with the present disclosure. The apparatus 100 may comprise headgear, such as protective headgear. For example, the apparatus 100 may protect a wearer during a competitive event.

The apparatus 100 may comprise a front section 102 and a back section 104. The back section 104 may extend from a back of (e.g., be attached to) the front section 102. The back section 104 may be attached to the front section 102. For example, the apparatus 100 may comprise a seam 106 attaching the front section 102 to the back section 104. The seam 106 may comprise one or more stitched lines along the seam 106.

The front section 102 may comprise a front top portion 108. The front top portion 108 may extend along the middle of a top of the apparatus 100. The front top portion 108 may extend backward (e.g., from the front) to cover at least a portion of a top of the head of the wearer.

The front section 102 may comprise a front left portion 110 and a front right portion 112. The front left portion 110 may extend backward to cover at least a portion of a left side of the head of a wear. The front right portion 112 may extend backward to cover at least a portion of a right side of the head of the wearer.

The front section 102 and the back section 104 may partially overlap. The back section 104 may comprise a back left portion 114 and a back right portion 116. The back left portion 114 and the back right portion 116 may at least partially surround the front top portion 108. The back left portion 114 may extend into a left recess between the front left portion 110 and the front top portion 108 of the front section 102. The back right portion 116 may extend into a right recess between the front right portion 112 and the front top portion 108.

The apparatus 100 may be breathable. For example, the front section 102 may comprise a plurality of openings to allow circulation of air inside the apparatus 100. The plurality of openings may comprise one or more of a top opening 118, a right side opening 120, a left side opening 122, a front left opening 124, and a front right opening 126. The back section 104 may comprise a breathable and/or flexible material. For example, back section 104 may comprise a mesh material. The back section 104 (e.g., the mesh material) may comprise a first plurality of airflow channels 128. The first plurality of air flow channels 128 may extend from an outer surface of the back section 104 to an inner surface of the back section 104. The first plurality of air flow channels 128 may have a thickness sufficient to provide a protective cushion for the head of the wearer. For example, the first plurality of air flow channels 128 may have a thickness of about 2 mm to about 10 mm. The first plurality of air flow channels 128 may have openings of any shape, such as hexagonal, circular, square, and/or the like. The first plurality of air flow channels 128 may be formed in a pattern, such as honeycomb pattern. The back section 104 (e.g., the mesh material) may comprise plastic, nylon, polyester, a combination thereof, and/or the like. The back section 104 may comprise a woven material, such as a plurality of fibers woven to form the mesh material.

Figure 7:
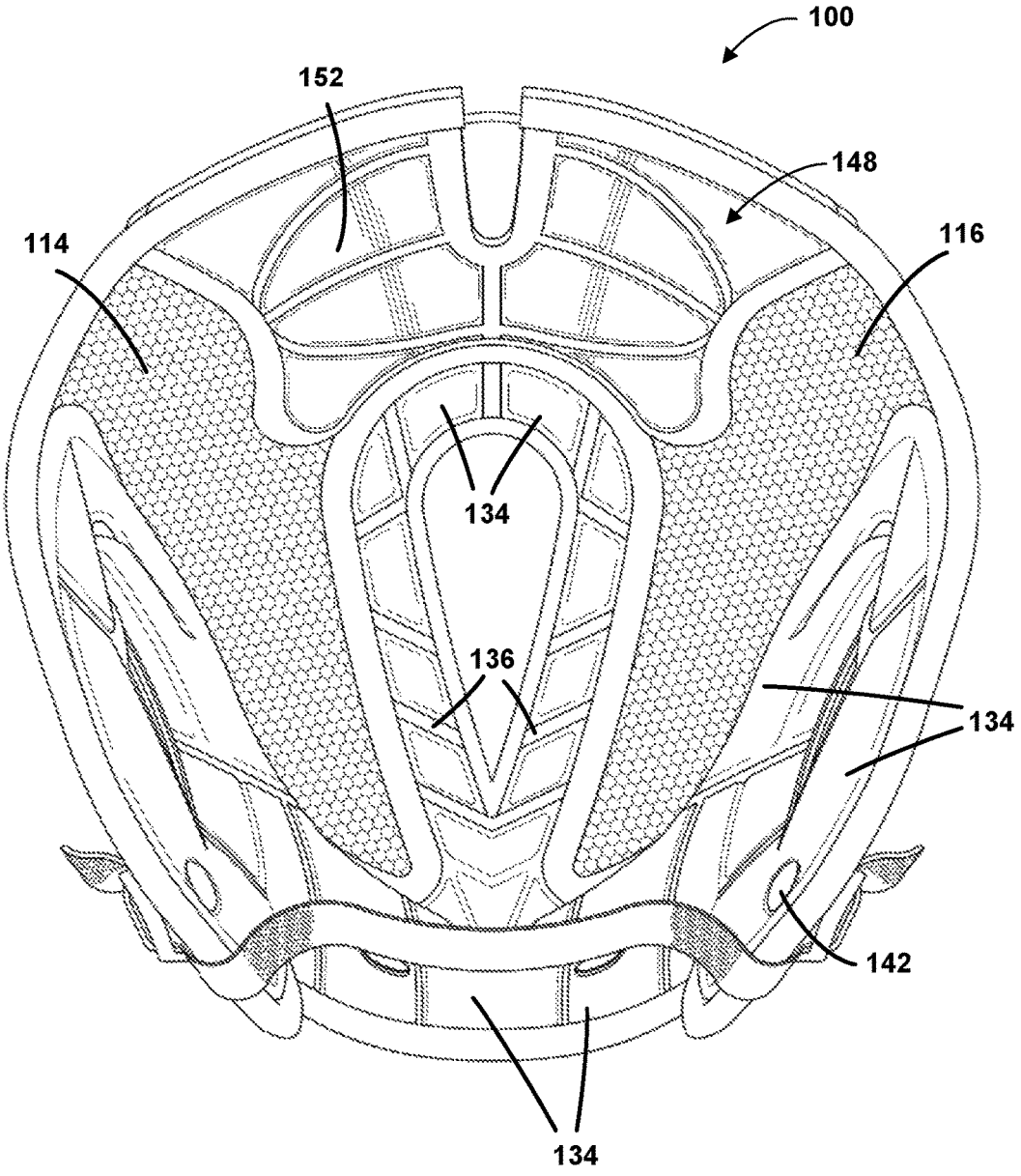
FIG. 7 is a bottom-up view of an example apparatus in accordance with the present disclosure.

The apparatus 100 may be configured to protect the head of a wearer. The front section 102 may comprise padding configured to conform to a shape of a head of a wearer. The padding of the front section 102 may comprise closed cell compression molded foam or other suitable material. The padding may comprise an outer padding 130. The outer padding 130 may be disposed on an exterior surface of the front section 102. The outer padding 130 may comprise a foam, such as a medium density foam, a medium density closed cell foam, and/or the like. The padding may comprise an inner padding 132. The outer padding 130 may be separated from the inner padding 132 by a middle layer. The middle layer may be semi-rigid. The middle layer may comprise a moldable composite core. The inner padding 132 may comprise a low density foam. The inner padding 132 may having a lower density than a density of the outer padding 130. The inner padding 132 may be disposed on an interior surface of the front section 102. The inner padding 132 may be compression molded. The inner padding 132 may comprise a first plurality of padded sections 134. The first plurality of padded sections 134 may be separated by a second plurality air flow channels 136. The plurality of padded section 134 may be disposed adjacent the head of the wearer. FIG. 7 is a bottom up view of the apparatus 100 and further illustrates the plurality of padded sections 134. The plurality of padded sections may be disposed on the sides and top of the inner surface of the front section 102.

Figure 2:
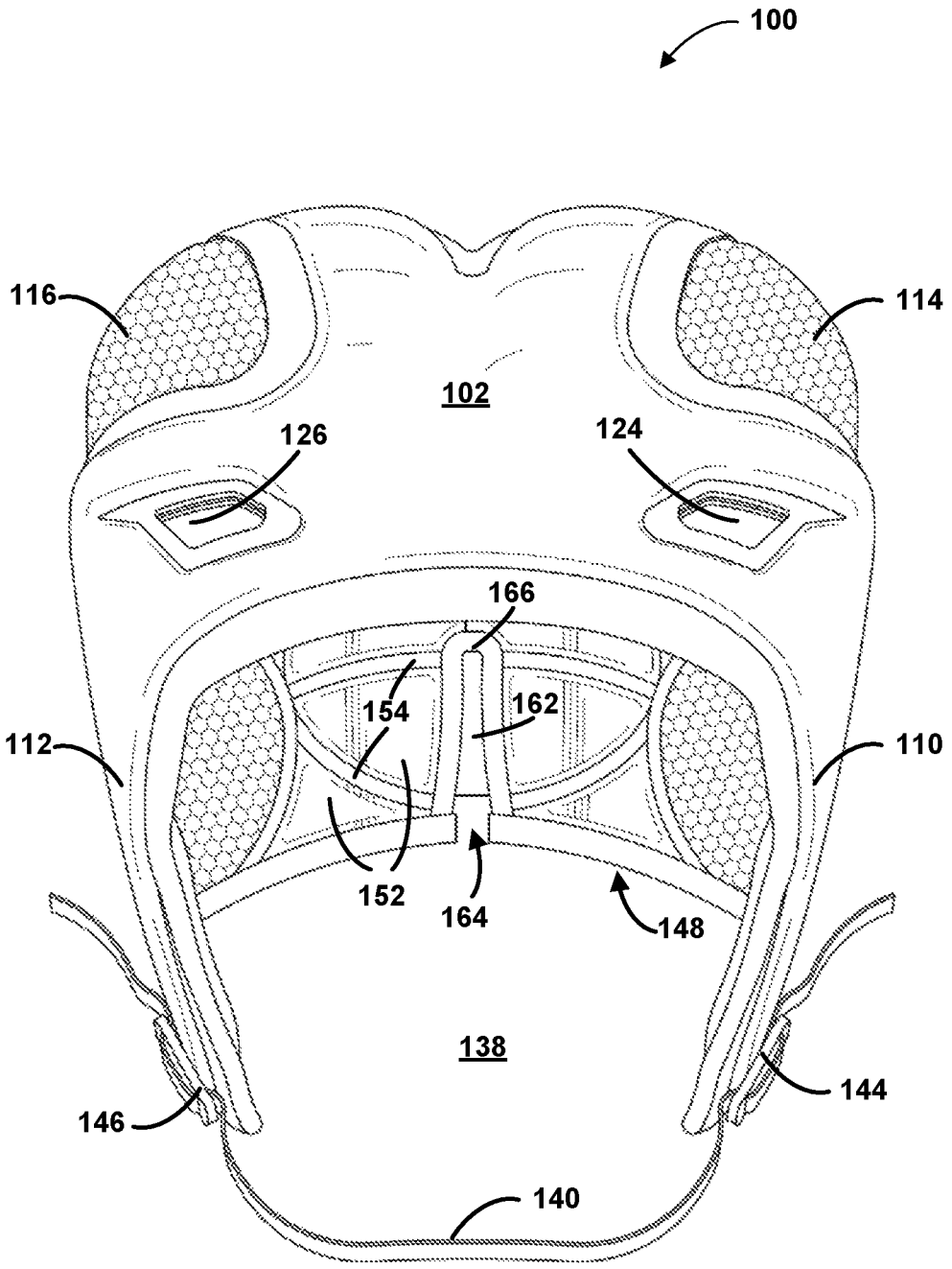
FIG. 2 is a front view of an example apparatus in accordance with the present disclosure.
Figure 3:
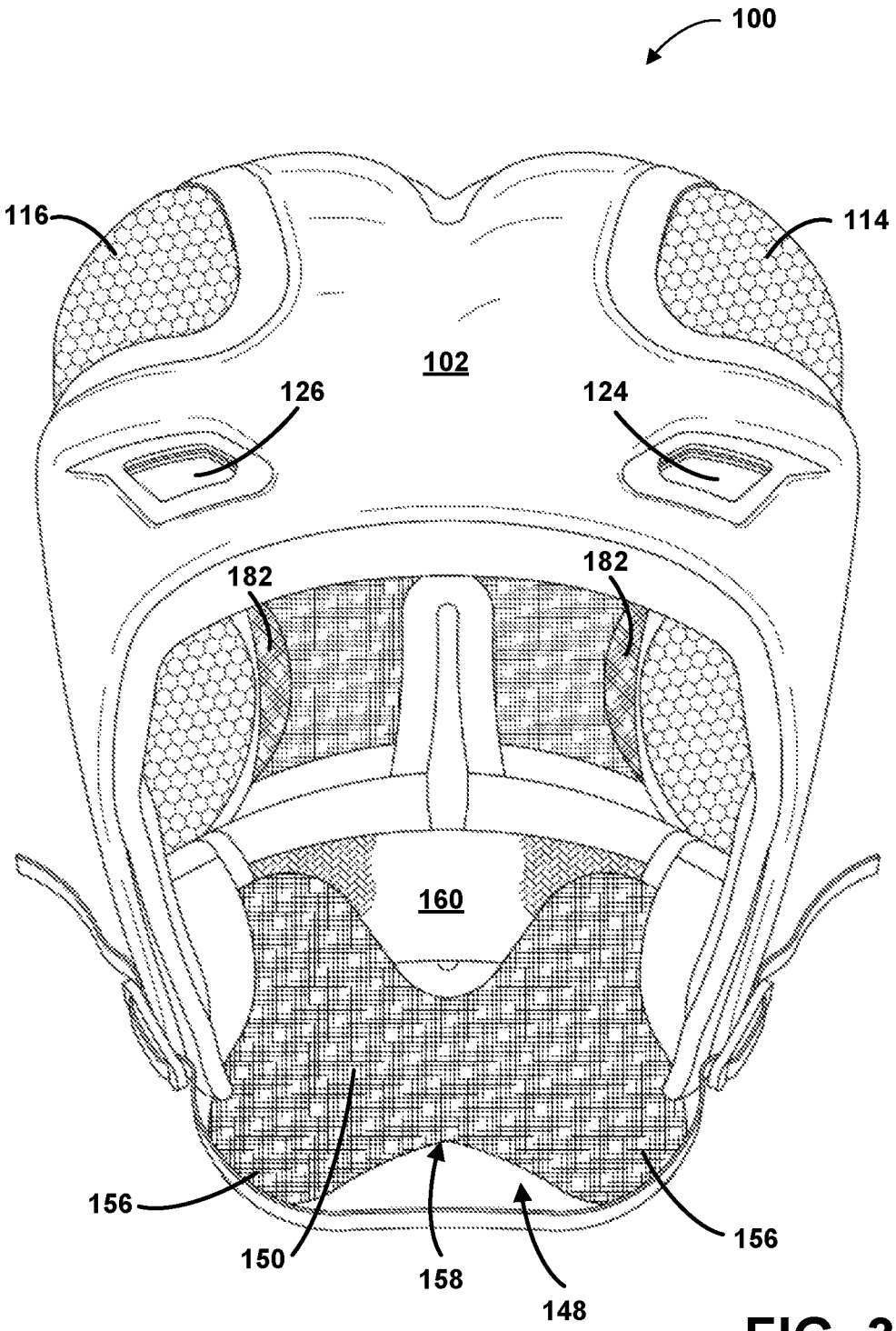
FIG. 3 is a front view of example apparatus illustrating an inner flap in accordance with the present disclosure.
Figure 4:
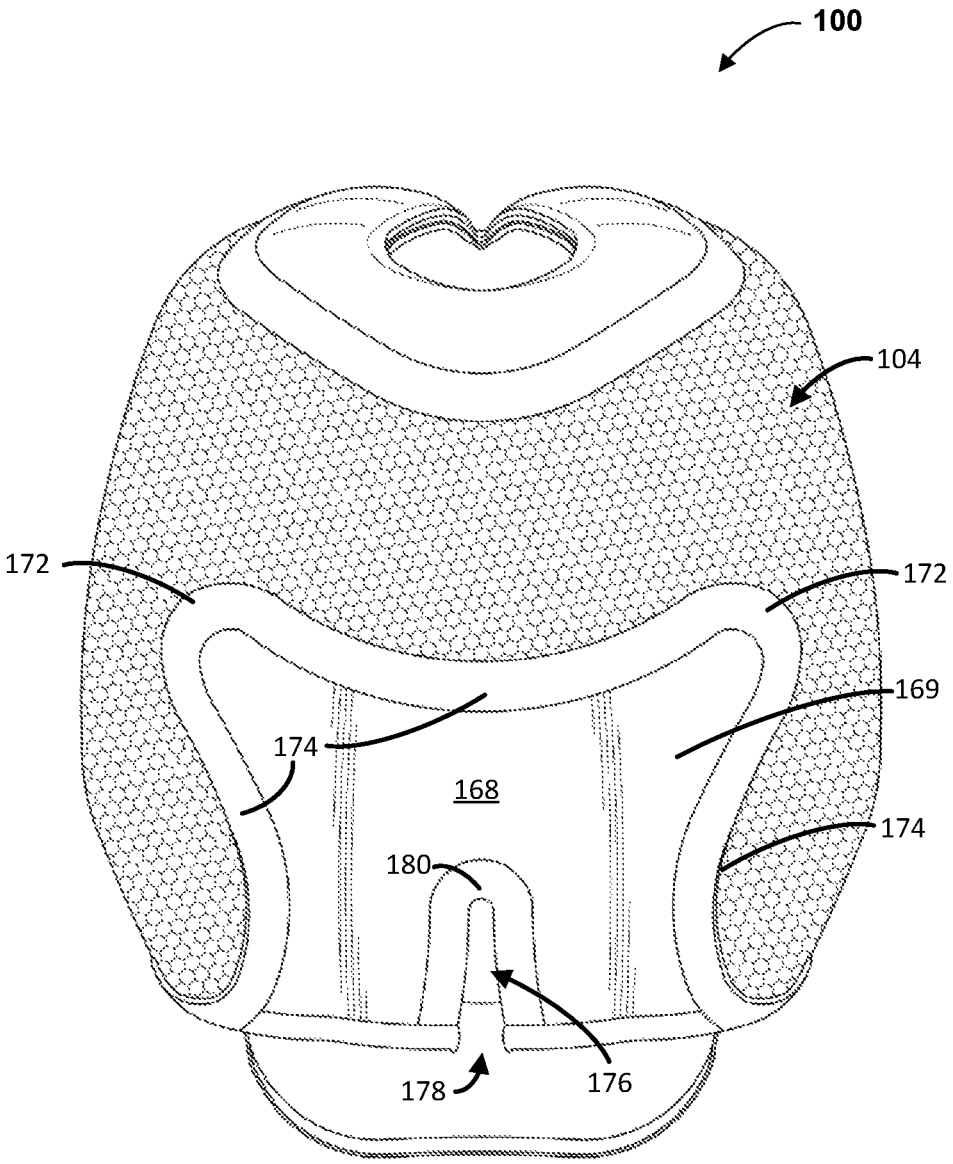
FIG. 4 is a back view of an example apparatus illustrating an outer flap in accordance with the present disclosure.
Figure 5:
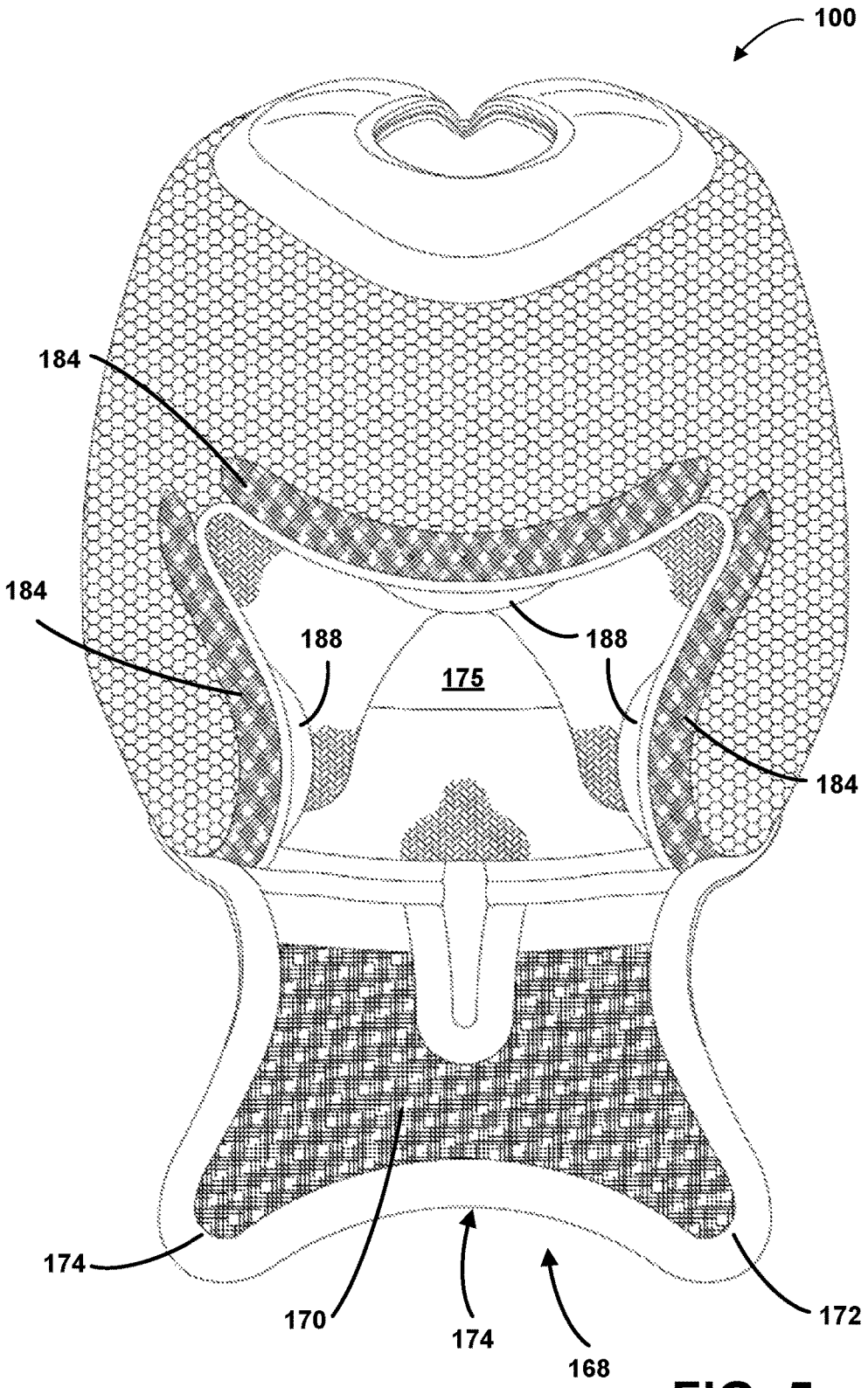
FIG. 5 is a back view of an example apparatus illustrating an outer flap in accordance with the present disclosure.

As illustrated in FIG. 2 through FIG. 5 as well as elsewhere herein, the apparatus 100 may be adjustable to conform to different head sizes of different wearers. FIG. 2 is a front view of an example apparatus in accordance with the present disclosure. FIG. 3 is a front view of an example apparatus illustrating an inner flap in accordance with the present disclosure. FIG. 4 is a back view of an example apparatus showing an outer surface of an example outer flap in accordance with the present disclosure. FIG. 5 is a back view of an example apparatus illustrating an inner side of an outer flap in accordance with the present disclosure.

As shown in FIG. 2, the front section 102 may comprise a front opening 138 for a face of the wearer. The apparatus 100 may comprise a strap 140. The strap 140 may comprise a chin strap configured to strap below a chin of the wearer. The strap 140 may attach to the front left portion 110 and the front right portion 112. For example, the strap 140 may comprise one side of one or more snap fasteners 142 and the front right portion 112 and/or front left portion 110 may comprise the other side of the one or more snap fasteners 142 (as shown in FIG. 1 and FIG. 7). The strap 140 may be adjusted using one or more strap adjusters 144 and 146. The one or more strap adjusters 144 and 146 may comprise, for example, one or more buckles, such as ladder lock buckles. A left strap adjuster 144 may be disposed around a left side of the strap 140. A right strap adjuster 146 may be disposed around a right side of the strap 140.

The apparatus 100 may comprise an adjustment system allowing the apparatus 100 to conform to a variety of head sizes of different wearers. As shown in FIG. 2 and FIG. 3, the adjustment system of the apparatus 100 may comprise an inner flap 148. FIG. 2 shows an inner side of the inner flap 148. FIG. 3 shows an outer side of the inner flap 148. At least a portion of a bottom side of the inner flap 148 may extend from and/or be attached to the back portion 104 of the apparatus 100.

The inner flap 148 may comprise an inner flap fastening region 150 on an outer side of the inner flap 148, as shown in FIG. 3. The inner flap fastening region 150 may comprise, for example, a plurality of hook and loop fasteners or other any other suitable type of set and release fasteners. The inner flap 148 may comprise padding on the inner side of the inner flap 148. The padding may comprise a second plurality of padded sections 152, as shown in FIG. 2. The plurality of padded sections 152 may comprise a low density interior foam. The second plurality of padded sections 152 may be separated by a third plurality of air flow channels 154. The inner flap 148 may have a curvilinear shape. For example, the inner flap may have one or more rounded corners 156. One or more sides 158 (e.g., between corners) of the inner flap 148 may taper inwardly (e.g., in a curved manner).

The inner flap 148 may comprise a flexible band 160, as shown in FIG. 3. The flexible band 160 may allow for horizontal and/or vertical adjustment of the size of the apparatus 100 and/or the inner flap 148. The flexible band 160 may be disposed between the inner side of the inner flap 148 and the outer sider of the inner flap 148. The flexible band 160 may be attached to opposite sides (e.g., a left side and a right side) of the inner flap 148. The flexible band 160 may comprise flexible material, such as a stretchable fabric, polyester, rubber, elastic, elastomer, neoprene, spandex, elastane, and/or the like.

The inner flap 148 may comprise an inner flap recess 162 extending from a side of the flap towards an interior of the inner flap 148, as shown in FIG. 2. For example, the inner flap recess 162 may extend from a bottom side of the inner flap 148. The inner flap recess 162 may be centered between the left side of the inner flap 148 and the right side of the inner flap 148. The inner flap recess 162 may taper from wider to narrower as the recess extends from the side to the interior of the inner flap 148. The inner flap recess 162 may comprise an opening 164 in the inner flap on the side of the inner flap 148. The inner flap recess 162 may comprise an interior end 166, which may be rounded. The interior end 166 may allow for the inner flap 148 to expand or contract (e.g., horizontally, vertically) as pulled upon by the wearer to adjust the size of the apparatus 100.

As shown in FIG. 4 and FIG. 5, the adjustment system of the apparatus 100 may comprise an outer flap 168 (e.g., or outer pad). FIG. 4 shows an outer side of the outer flap 168. FIG. 5 shows an inner side of the outer flap 168. The outer flap 168 may comprise one or more sides extending from (e.g., or attached to) the back section 104. For example, at least a portion of a bottom side of the outer flap 168 may be attached to the back portion 104 of the apparatus 100. As another example, at least a portion of the bottom side of the outer flap 168 may extend from and/or be attached to at least a portion of the inner flap (e.g., a bottom side of the inner flap).

The outer flap 168 may comprise padding on an outer side of the outer flap 168. The padding may comprise medium density foam as described elsewhere herein. The outer flap 168 may comprise an outer flap fastening region 170 on an inner side of the outer flap 168. The outer flap fastening region 170 may comprise a plurality of hook and loop fasteners (e.g., or other set and release fastener). The outer flap 168 may have a curvilinear shape. For example, the outer flap 168 may have one or more rounded corners 172. One or more sides 174 (e.g., between corners) of the outer flap 168 may taper inwardly (e.g., in a curved manner, towards the center of the side from the outer portion of the side).

The outer flap 168 may comprise an outer flap recess 176 extending from a side of the flap towards an interior of the outer flap 168. For example, the outer flap recess 176 may extend from a bottom side of the outer flap 168. The outer flap recess 176 may be centered between the left side of the outer flap 168 and the right side of the outer flap 168. The outer flap recess 176 may taper from wider to narrower as the recess extends from the side to the interior of the outer flap 168. The outer flap recess 176 may comprise an opening 178 in the outer flap 168 on the side of the outer flap 168. The outer flap recess 176 may comprise an interior end 180, which may be rounded. The interior end 180 may allow for the outer flap 168 to expand or contract (e.g., horizontally, vertically) as pulled upon by the wearer to adjust the size of the apparatus 100.

The inner flap 148 and/or the outer flap 168 may removeably attach to the back section 104. The inner flap 148 and/or the outer flap 168 may be configured to removeably cover a back opening 175 of the back section 104 (e.g., as shown in FIG. 5). For example, the inner flap 148 and/or outer flap 168 may fold upwards over the back opening 175.

The inner flap 148 and/or outer flap 168 may removeably attach to one or more fastener regions (e.g., disposed on the back section 104). The one or more fastener regions may comprise a plurality of hook and loop fasteners or other set and release fastener systems. The one or more fastener regions may be circular, rectangular, rounded, curved, and/or the like. The one or more fastener regions may match the shape of the back opening 175. For example, if the back opening 175 is curvilinear, the one or more fastener regions may be curvilinear.

The one or more fastener regions may comprise one or more inner fastener regions 182 disposed on an inner side of the back section 104 (as shown in FIG. 3). The inner flap 148 may be configured to removeably attach to the inner fastener regions 182. The one or more inner fastener regions 182 may comprise an inner fastener region disposed on a top side of the back opening 175, an inner fastener region disposed on a right side of the back opening 175, an inner fastener region disposed on a left side of the back opening 175, a combination thereof, and/or the like.

The one or more fastener regions may comprise one or more outer fastener regions 184 disposed on an outer side of the back section 104. The outer flap 168 may be configured to removeably attach to the one or more outer fastener regions 184. The one or more outer fastener regions 184 may comprise an inner fastener region disposed on a top side of the back opening 175, an inner fastener region disposed on a right side of the back opening 175, an inner fastener region disposed on a left side of the back opening 175, a combination thereof, and/or the like.

The back section 104 may comprise one or more adjustment members 186. The one or more adjustment members 186 may provide a wearer with a surface to pull upon to adjust the size of the apparatus 100 (e.g., and the back opening 175). The one or more adjustment members 186 may be configured to removeably attach to the inner flap 148 when the inner flap 148 is at least partially covering the back opening, thereby adjusting a size of the apparatus 100 and causing padding of the apparatus 100 to conform to a head of a wearer. The one or more adjustment members 186 may be configured to removeably attach to the outer flap 168 when the outer flap 168 is at least partially covering the back opening, thereby adjusting a size of the apparatus 100 and causing padding of the apparatus 100 to conform to a head of a wearer.

The one or more adjustment members 186 may define and/or be adjacent the back opening 175 in the back section 104. The one or more adjustment members 186 may comprise one or more adjustment tabs 188. The one or more adjustment tabs 188 may extend from and/or be attached to the one or more adjustment members 186. The one or more adjustment tabs 188 may be pull tabs. The one or more adjustment tabs 188 may comprise rubber, plastic, and/other slip resistive material. The one or more adjustment tabs 188 may comprise a ridge (e.g., to increase dexterity) along an outer edge of the one or more adjustment tabs 188. For example, the one or more adjustment members may comprise curved members extending from the back section 104 (e.g., into the back opening 175). The one or more adjustment members 186 (e.g., the curved members) may be separated from each other by one or more recesses, such as curved recesses.

The one or more adjustment members 186 may comprise a first adjustment member (e.g., or first adjustment tab) defining a top of the opening. The one or more adjustment members may comprise a second adjustment member (e.g., or second adjustment tab) defining a left side of the opening. The one or more adjustment members may comprise a third adjustment member (e.g., or third adjustment tab) defining a right side of the opening.

The inner flap 148 and/or the outer flap 168 may removeably attach to the one or more adjustment members 186 to define a horizontal adjustment and a vertical adjustment of the back section 104. For example, the one or more adjustment members 186 may comprise the one or more fastener regions, such as the one or more inner fastener regions 182 and the one or more outer fastener regions 184. The one or more adjustment members 186 may comprise a first side of hook and loop fasteners and the inner flap 148 and/or outer flap 168 may comprise a second side of the hook and loop fasteners.

Figure 6:
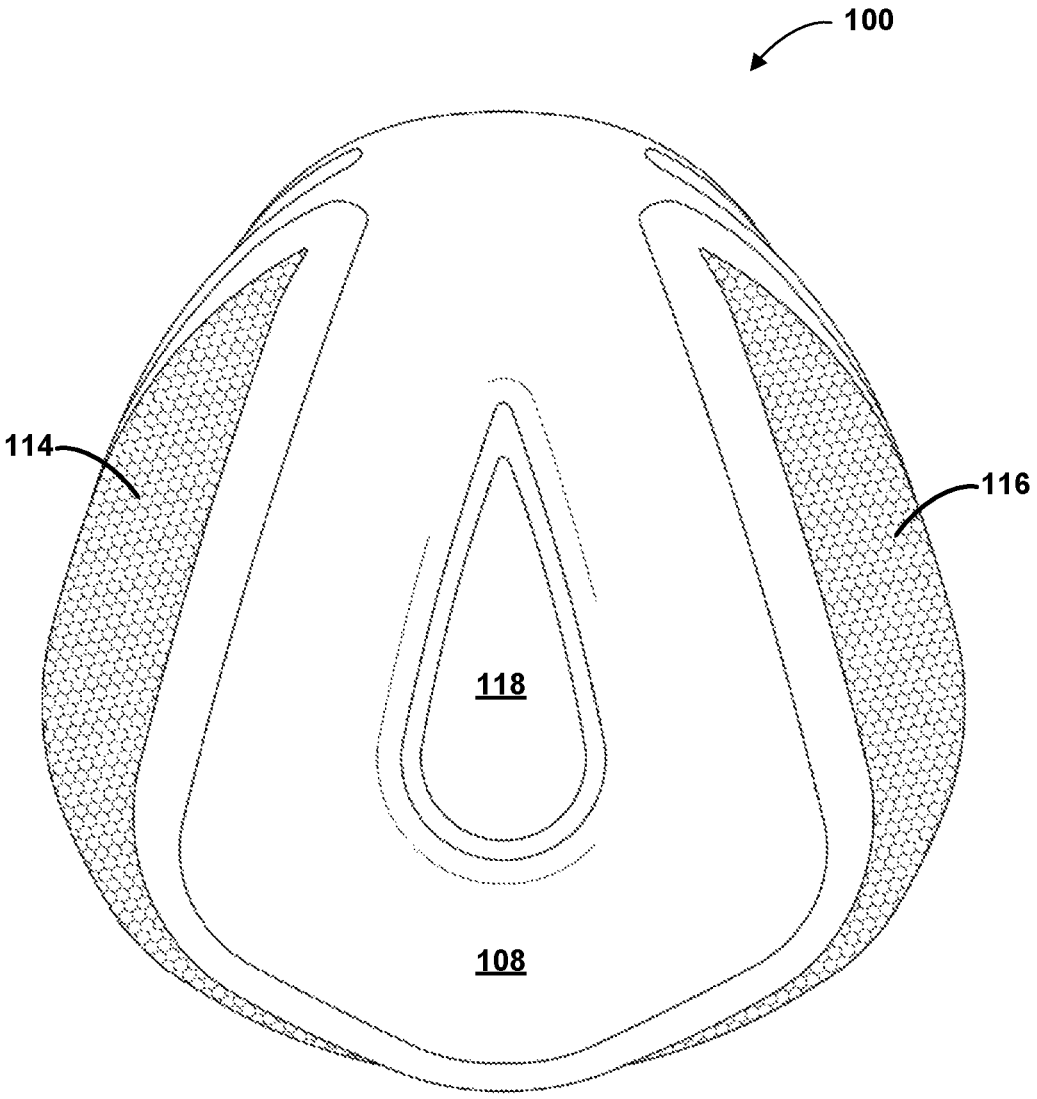
FIG. 6 is a top-down view of an example apparatus in accordance with the present disclosure.
Figure 8:
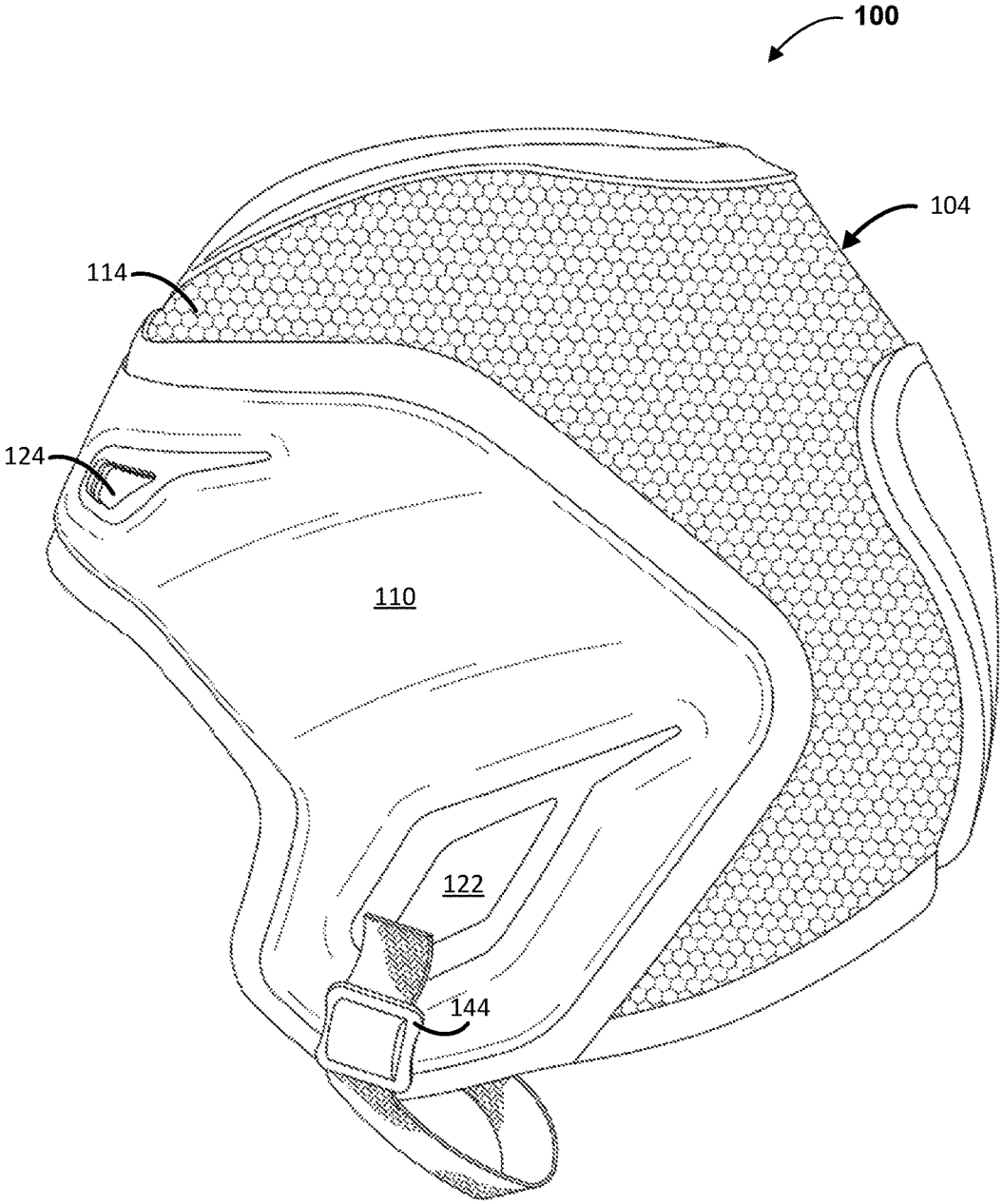
FIG. 8 is a side view of an example apparatus in accordance with the present disclosure.
Figure 9:
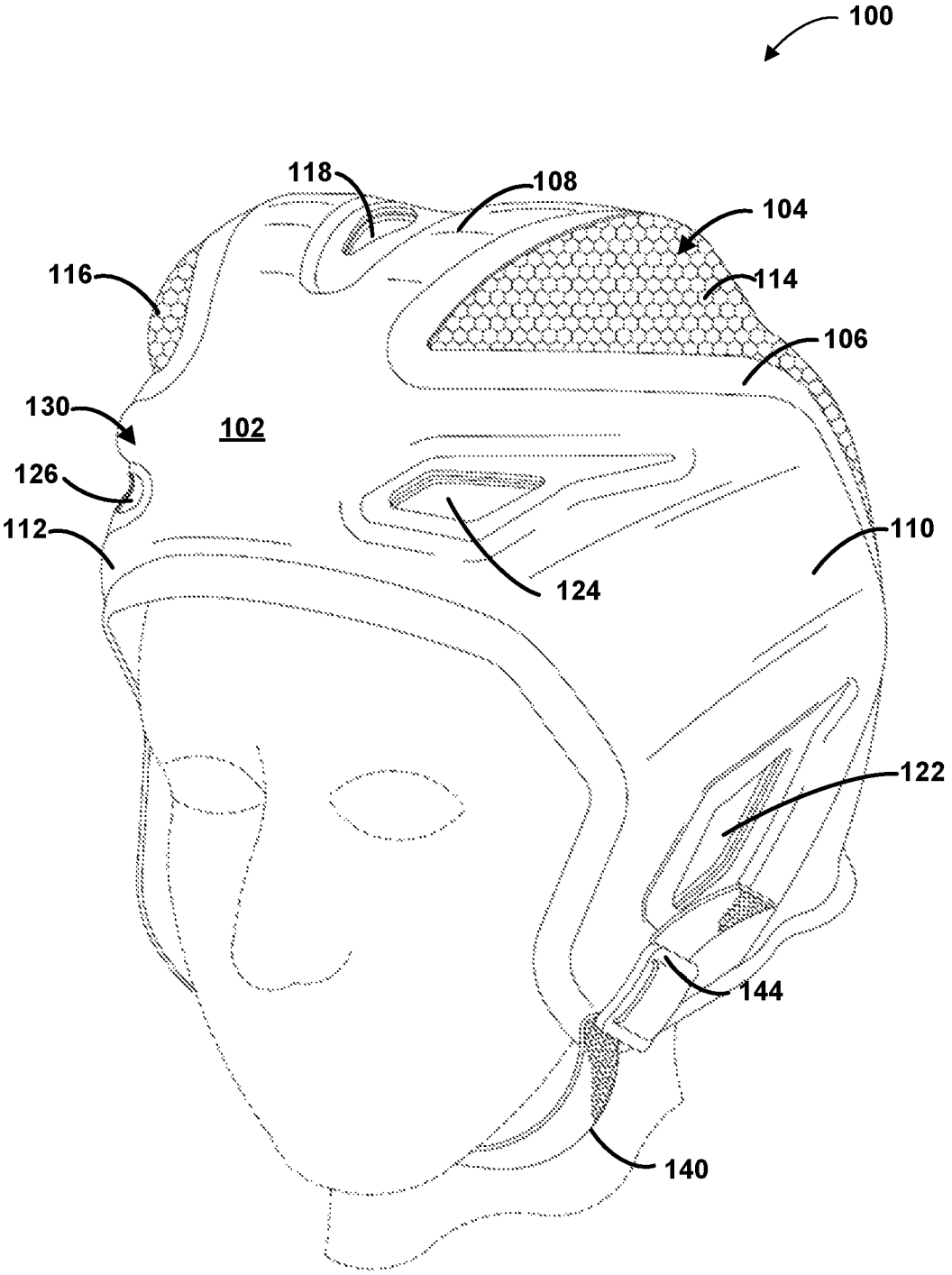
FIG. 9 is a front perspective view of an example apparatus on the head of a wearer in accordance with the present disclosure.

FIG. 6 through FIG. 9 show additional views illustrating the example apparatus 100. FIG. 6 is a top-down view of an example apparatus in accordance with the present disclosure. The back left portion 114, the back right portion 112, and the top opening 118 are shown in further detail. FIG. 7 is a bottom-up view of an example apparatus in accordance with the present disclosure. The first plurality of padded sections 134 are shown in further detail. FIG. 8 is a side view of an example apparatus in accordance with the present disclosure. The front left portion 110, back left portion 114, front left opening 124, a left side opening 122, and left strap adjuster 144 are shown in further detail. FIG. 9 is a front perspective view of an example apparatus on the head of a wearer in accordance with the present disclosure.

While the present embodiments have been described in connection with the various figures, it is to be understood that other similar embodiments may be used or modifications and additions may be made to the described embodiment for performing the same function as the disclosed subject matter without deviating therefrom. All such embodiments are contemplated as within the scope of the present disclosure.

What is claimed:

1. A protective headgear comprising:

a front section comprising padding configured to conform to a shape of a head of a wearer;

a back section attached to the front section, wherein the back section comprises one or more adjustment members adjacent an opening in the back section; and one or more pads configured to removably attach to the one or more adjustment members to define a horizontal adjustment and a vertical adjustment of the back section and at least partially cover the opening in the back section.

2. The protective headgear of claim 1, wherein the back section comprises a mesh material.

3. The protective headgear of claim 1, wherein the one or more pads comprise an inner pad configured to attach to an inner side of the one or more adjustment members and an outer pad configured to attach to an outer side of the one or more adjustment members.

4. The protective headgear of claim 1, wherein the one or more adjustment members comprise a first adjustment tab defining a top of the opening, a second adjustment tab defining a left side of the opening, and a third adjustment tab defining a right side of the opening.

5. The protective headgear of claim 1, wherein the one or more adjustment members comprise curved members extending from the back section, and wherein the curved members are separated from each other by one or more curved recesses.

6. The protective headgear of claim 1, wherein the one or more adjustment members comprise a first side of hook and loop fasteners and the one or more pads comprise a second side of the hook and loop fasteners.

7. The protective headgear of claim 1, wherein the padding of the front section comprises closed cell compression molded foam.

8. The protective headgear of claim 1, wherein the padding comprises an outer foam layer, a semi-rigid moldable composite core, and an inner foam layer having a lower density than a density of the outer foam layer.

9. The protective headgear of claim 8, wherein the inner foam layer comprises a plurality of padded sections separated by air flow channels and disposed adjacent the head of the wearer.

10. The protective headgear of claim 1, wherein the front section comprises a front opening for a face of the wearer, a front left portion extending backward to cover at least a portion of a left side of the head of the wearer, a front right portion extending backward to cover at least a portion of a right side of the head of the wearer, and a top portion extending backward to cover at least a portion of a top of the head of the wearer, and wherein the back section comprises a back left portion that extends into a left recess between the front left portion and the top portion of the front section, and wherein the back section comprises a back right portion that extends into a right recess between the front right portion and the top portion of the front section.

11. An apparatus comprising a three-point adjustment system comprising three hook and loop closure points disposed in a back opening of a protective headgear and allowing for horizontal adjustment and vertical adjustment of a size of the protective headgear, wherein the protective headgear comprises a padded section configured to conform to a shape of a head of a wearer.

12. The apparatus of claim 11, wherein the protective headgear comprises a front section and back section, and wherein the back section comprises a mesh material.

13. The apparatus of claim 12, wherein the front section comprises a front opening for a face of the wearer, a front left portion extending backward to cover at least a portion of a left side of the head of the wearer, a front right portion extending backward to cover at least a portion of a right side of the head of the wearer, and a top portion extending backward to cover at least a portion of a top of the head of the wearer, and wherein the back section comprises a back left portion that extends into a left recess between the front left portion and the top portion of the front section, and wherein the back section comprises a back right portion that extends into a right recess between the front right portion and the top portion of the front section.

14. The apparatus of claim 11, wherein the three hook and loop closure points are disposed on one or more adjustment tabs adjacent the back opening.

15. The apparatus of claim 14, wherein the one or more adjustment tabs comprise a first adjustment tab defining a top of the back opening and comprise a first hook and loop closure point, a second adjustment tab defining a left side of the back opening and comprising a second hook and loop closure point, and a third adjustment tab defining a right side of the back opening and comprising a third hook and loop closure point.

16. The apparatus of claim 14, wherein the one or more adjustment tabs comprise curved members separated from each other by one or more curved recesses.

17. The apparatus of claim 14, wherein the padded section comprises an inner pad configured to attach to an inner side of the one or more adjustment tabs and an outer pad configured to attach to an outer side of the one or more adjustment tabs.

18. The apparatus of claim 14, wherein the one or more adjustment tabs comprise a first side of hook and loop fasteners and one or more pads attached to the protective headgear comprise a second side of the hook and loop fasteners.

19. The apparatus of claim 11, wherein the padded section comprises a closed cell compression molded foam.

20. The apparatus of claim 11, wherein the padded section comprises an outer foam layer, a semi-rigid moldable composite core, and an inner foam layer having a lower density than a density of the outer foam layer.

21. The apparatus of claim 20, wherein the inner foam layer comprises a plurality of padded sections separated by air flow channels and disposed adjacent the head of the wearer.

22. An adjustment system for protective headgear comprising:

a first adjustment member defining a first portion of a back opening of a protective headgear;

a second adjustment member defining a second portion of the back opening;

a third adjustment member defining a third portion of the back opening; and a flap configured to removably cover at least a portion of the back opening, wherein the first adjustment member, the second adjustment member, and the third adjustment member are configured to removably attach to the flap when at least partially covering the back opening, thereby adjusting a size of the protective headgear and causing padding of the protective headgear to conform to a head of a wearer.

23. The adjustment system of claim 22, wherein the first portion of the back opening comprises a first side of the back opening, the second portion of the back opening comprises a second side of the back opening, and the third portion of the back opening comprises a third side of the back opening.

24. The adjustment system of claim 22, wherein one or more of the first adjustment member, the second adjustment member, or the third adjustment member extend into the back opening.

25. The adjustment system of claim 22, wherein one or more of the first adjustment member, the second adjustment member, or the third adjustment member comprise a first side of hook and loop fasteners, and wherein the flap comprises a second side of the hook and loop fasteners.

26. The adjustment system of claim 22, wherein one or more of the first adjustment member, the second adjustment member, or the third adjustment member comprise a curved member extending into the back opening, and wherein the curved members are separated from each other by one or more curved recesses.

27. The adjustment system of claim 22, wherein the protective headgear comprises a flexible back section, and wherein the first adjustment member, the second adjustment member, and the third adjustment member are attached to the flexible back section.

28. The adjustment system of claim 22, wherein the flap is disposed on an outside of the back opening, and wherein adjustment system further comprises an inner flap disposed on an inside of the back opening, and wherein the inner flap comprises a flexible band.

29. The adjustment system of claim 22, wherein the flap comprises a recess extending from a side of the flap towards an interior of the flap.

* * * * *